United States Patent [19]

Terashima et al.

[11] 4,338,019

[45] Jul. 6, 1982

[54] METHOD FOR OPERATING ELECTROPHOTOGRAPHIC COPYING APPARATUS

[75] Inventors: Isamu Terashima; Shigeru Uchida; Eiiji Senba, all of Hitachi, Japan

[73] Assignee: Hitachi, Ltd., Tokyo, Japan

[21] Appl. No.: 208,580

[22] Filed: Nov. 20, 1980

[30] Foreign Application Priority Data

Nov. 26, 1979 [JP] Japan ..... 54/151972

[51] Int. Cl.[3] ..... G03G 15/00

[52] U.S. Cl. ..... 355/14 D; 118/657; 118/688; 355/3 DD; 355/77; 430/120

[58] Field of Search ..... 355/3 DD, 14 D, 14 R, 355/77; 430/120-122; 118/657, 658, 688

[56] References Cited

U.S. PATENT DOCUMENTS 3,503,776 3/1970 Gundlach ..... 430/121

4,240,375 12/1980 Terashima ..... 355/3 DD

*Primary Examiner*—R. L. Moses

*Attorney, Agent, or Firm*—Craig and Antonelli

[57] ABSTRACT

There is disclosed a method for operating an electrophotographic copying apparatus having a latent image forming unit for forming an electrostatic latent image on a recording medium, a development unit for visualizing the electrostatic latent image with a developer containing toner and carrier to produce a visible toner image, and a fixing unit for fixing the toner image. In this operation method, the development unit is raced until the amount of charge on the toner in the developer reaches a predetermined level, and thereafter a usual electrophotographic copying procedure commences, whereby reduction in density of developed images during the initial operation of the electrophotographic copying apparatus can be prevented and developed images of high quality can be obtained.

7 Claims, 8 Drawing Figures

METHOD FOR OPERATING ELECTROPHOTOGRAPHIC COPYING APPARATUS

This invention relates to a method for operating an electrophotographic copying apparatus, especially, an electrophotographic copying apparatus using a developer containing toner and carrier.

Typically, the electrophotographic copying apparatus comprises a latent image forming unit for forming an electrostatic latent image on a recording medium such as a photosensitive drum by electrostatically charging the recording medium or exposing it to light, a development unit for visualizing the electrostatic latent image with a developer to produce a visible toner image, a transfer unit for transferring the toner image onto a transfer medium, and a fixing unit for fixing the transferred toner image to the transfer medium.

To develop the electrostatic latent image on the recording medium, a well-known magnetic brush method or cascade method is employed wherein a two-component developer is used which contains toner particles having electrically insulative surfaces and carrier particles, the toner and carrier particles are stirred to be charged by friction such that the toner is charged at a polarity opposite to that of the latent image, and the toner is adhered to the latent image surface by Coulomb force interacting between the toner particle and the latent image charge to thereby complete development.

In order to obtain a stable developed image with the electrophotographic copying apparatus, the electrostatic charge and concentration of the toner in the developer are required to remain constant.

Since constant toner density in the developer favorably affects the image formation during development, various toner density monitoring and controlling methods have hitherto been proposed including an electrostatic method as disclosed in U.S. Pat. No. 4,064,834.

However, even if the toner density in the developer is kept constant, the developed image tends to decrease in density during the initial operation of the electrophotographic copying apparatus. Especially, in high speed copiers available in recent years, it was inevitable that copies of stable quality at the cost of a number of initial low density image copies were obtained. Disadvantageously, the number of the initial low density image copies increased with the working time of the developer. Furthermore, the occurrence of this phenomenon is aggravated in an electrophotographic copying apparatus which has not been used for a long time.

This phenomenon is due to shortage of electric charge on the toner and in the case of usage of a fatigued developer containing carriers mainly adhered with spent toners, it takes a long time before the developer is sufficiently stirred to cause frictional charge on the toner to become saturated.

The present invention contemplates elimination of the conventional drawbacks and has for its major object to provide a method for operating an electrophotographic copying apparatus which can prevent reduction in density of initial developed images, thereby producing images of high quality.

To accomplish the above object, according to the present invention, a development unit is raced until the amount of charge on the toner reaches a predetermined level, that is to say, the development unit is operated without allowing a latent image forming unit to perform the latent image formation under the consumption and feed of a developer until the amount of charge on the toner in the developer can be raised to the predetermined level, and thereafter an electrophotographic copying procedure commences.

Other features and advantages of the invention will fully be understood from the following detailed description taken in conjunction with the accompanying drawings, in which.

Figure 1:
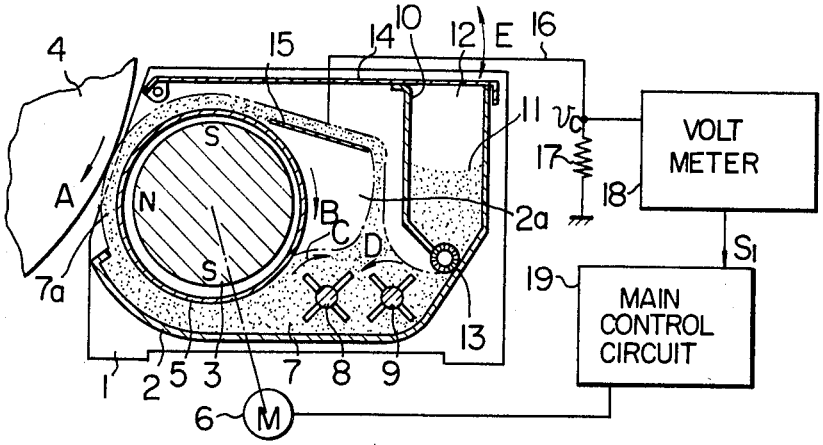
FIG. 1 is a partial sectional view of an electrophotographic copying apparatus, especially a development unit thereof, for practising an operation method according to the invention.

Referring to FIG. 1, there is shown an electrophotographic copying apparatus, especially, a development unit thereof adapted to practise an operation method embodying the invention.

As shown therein, two opposing side plate 1, spaced at a predetermined distance, and a U-shaped bottom plate 2 lying therebetween constitute a developer container 2*a*. A permanent magnet 3 having an S-N-S magnetized peripheral surface is fixedly mounted to the side plates 1 with its N pole facing a photosensitive drum 4 which is rotatable in a direction of arrow A. A non-magnetic sleeve 5 surrounding the magnet 3 is rotatably mounted in concentric relationship therewith and driven by a motor 6 in a direction of arrow B. Developer powder 7 received in the developer container 2*a* is partly adhered to the peripheral surface of the sleeve 5 by magnetic force of the magnet 3. When the sleeve 5 is driven by the motor 6 to rotate in the direction of arrow B, the developer powder 7 adhered to the peripheral surface of the sleeve 5 is also moved in the same direction to form a magnetic brush 7*a*. Stirrers 8 and 9 adapted to stir the developer powder 7 so as to create frictional charge on the toner are rotatable in cooperation with the sleeve 5 in directions of arrow C and arrow D, respectively. A partition plate 10 secured to the side plates 1 constitutes a hopper 12 which contains fresh toner 11 to be fed. A feed valve 13 is rotatably supported by the side plates 1 discharges the toner 11 when toner density in the developer 7 is decreased. A lid 14 for covering upper openings of the developer container 2*a* and hopper 12 is pivoted for rotation in a direction of arrow E.

An electrically conductive plate 15 acting as an electroscope scratches off the magnetic brush 7*a* formed on the peripheral surface of the sleeve 5 and picks up current corresponding to charge on the developer toner so that the current may be grounded and discharged via a conductor 16 and a high resistance resistor 17. A high input impedance voltmeter 18 adapted to detect a voltage Vc developing across the resistor 17 due to the current flowing therethrough constitutes a charge detector circuit which produces an output signal $S_1$ when the voltage Vc exceeds a predetermined voltage $Vs_1$. A main controller circuit 19 is responsive to external control inputs including the signal $S_1$ to control a load including the motor 6 as the copying operation proceeds.

Figure 2:
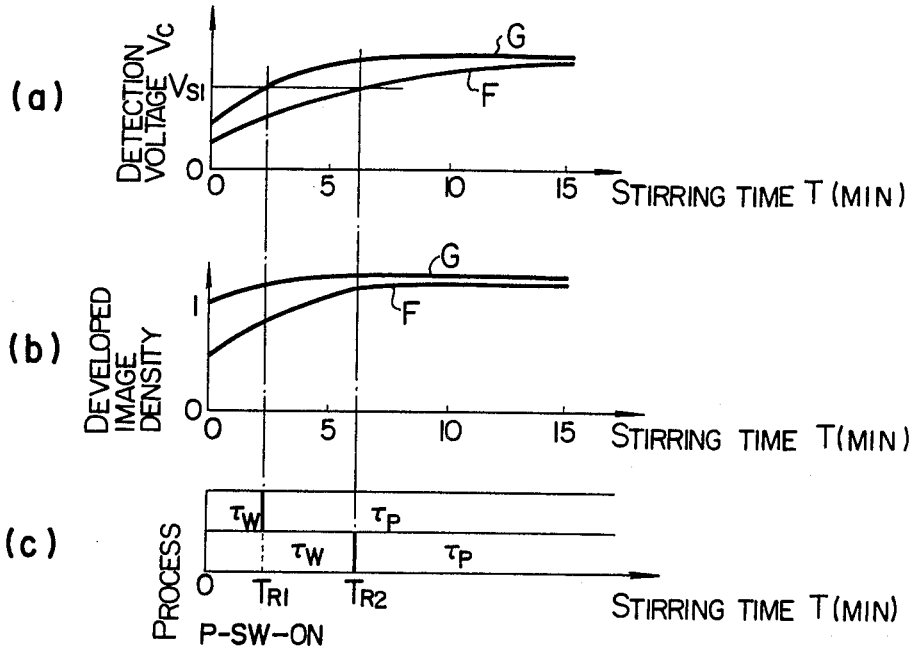
FIG. 2 illustrates in sections (a) through (c) the relation between time for stirring the developer and detection voltage (Vc), developed image density and operation process.

Experimental results of the toner charge or detection voltage Vc and developed image density on the photosensitive drum 4 as well as operation processes according to the present embodiment are plotted in sections (a) through (c) in FIG. 2 with respect to time for stirring the developer of a constant toner density. As will be seen from FIG. 2, the detection voltage Vc increases with developer stirring time T and the developed image density also does so. Degree of the increasing tendency is low for an old developer as shown by curve F whereas it is high for a fresh developer as shown by curve G.

When main power to the apparatus is turned on, a waiting process $\tau w$ commences in which the main controller circuit 19 applies voltage to the motor 6 to rotate the sleeve 5 and stirrers 8 and 9 so that the developer 7 is stirred. During the waiting process, the feed valve 13 is not allowed to operate.

When the developer toner charge reaches a predetermined level for obtaining a predetermined developed image density by stirring the developer at time $T_{R1}$ for the fresh developer and at time $T_{R2}$ for the old developer as shown in sections (a) and (b) in FIG. 2, the charge detector circuit 18 delivers the signal $S_1$ and an electrophotographic copying process $\tau_p$ including charging, light-exposure, development, transfer and fixing commences under the control of the main controller circuit 19. In this manner, reduction in the initial developed image density can be prevented.

Incidentally, according to permeability detection type toner density control apparatus as proposed in U.S. Pat. No. 3,572,551 and U.S. patent application Ser. No. 127,634 filed Mar. 6, 1980 and assigned to the same assignee as this application, the toner density is controlled by detecting permeability of the developer based on the fact that the carrier of the developer is magnetic and hence the toner density has an intimate relation to permeability of the developer. Such toner concentration control apparatus utilizing permeability detection can take part in detecting the amount of charge on the toner in the developer.

As described above, the carrier and toner are electrostatically charged by friction so that the toner is adhered to the surface of the carrier. Consequently, the apparent developer density is decreased under the influence of the frictional charge as compared with the developer density in the form of a mixture of toner and carrier which is not subject to the frictional charge. Namely, for the developer in the form of a mixture of toner and carrier at a constant mixing ratio, the developer density is lower immediately after the developer is sufficiently stirred than after the developer not been used for a long time.

Figure 3:
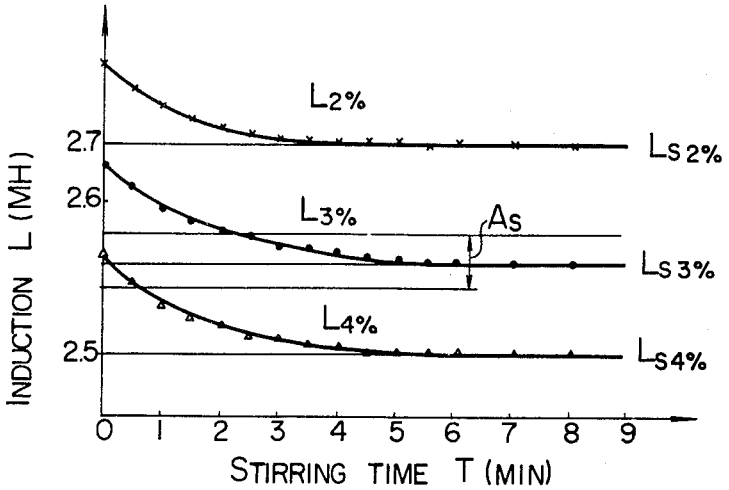
FIG. 3 is a graphic representation showing stirring characteristics of the developer.

When the developer is out of use, electrostatic charge on the carrier and toner disappears by discharging, usually, in 3 to 10 days although depending on environment in which the developer is placed and material of the developer. On the other hand, time for the developer to bear a saturated frictional charge depends on stirring efficiency of the stirrer included in the development unit and the amount and material of the developer. However, when a developer practically used is incorporated in a practically available development unit, it has been established experimentally as shown in FIG. 3 that 90% saturation is attained in 3 to 10 minutes.

Thus, when an electrophotographic copying apparatus which not been used for a long time is restarted, the developer permeability is detected as a function of the apparent density of the developer. Accordingly, a conventional problem was such that when a permeability detection type toner density control apparatus was restarted, the supply of toner exceeding an initial proper range $A_S$ occurred, resulting in excess of toner. With reference to examples shown in FIG. 3, a developer having a standard toner density of 3% is detected as having a toner density of about 2% so that an amount of excessive toner is fed up to an ultimate toner density of about 4%. In FIG. 3, stirring characteristics of 2%, 3% and 4% toner density developers are plotted at curves $L_{2\%}$, $L_{3\%}$ and $L_{4\%}$, and standard toner density levels of these developers are represented by straight lines $L_{S2\%}$, $L_{S3\%}$ and $L_{S4\%}$.

Another conventional problem was an erroneous setting of toner density which arises from failure to stir a fresh or refreshed developer.

These conventional problems can be solved by commencement of the electrophotographic copying process following the waiting process in which, as described above, the development unit is raced until the toner charge reaches a predetermined level which is detected by a permeability detection type toner density control apparatus which takes part in detecting charge on the toner in the developer.

Figure 4:
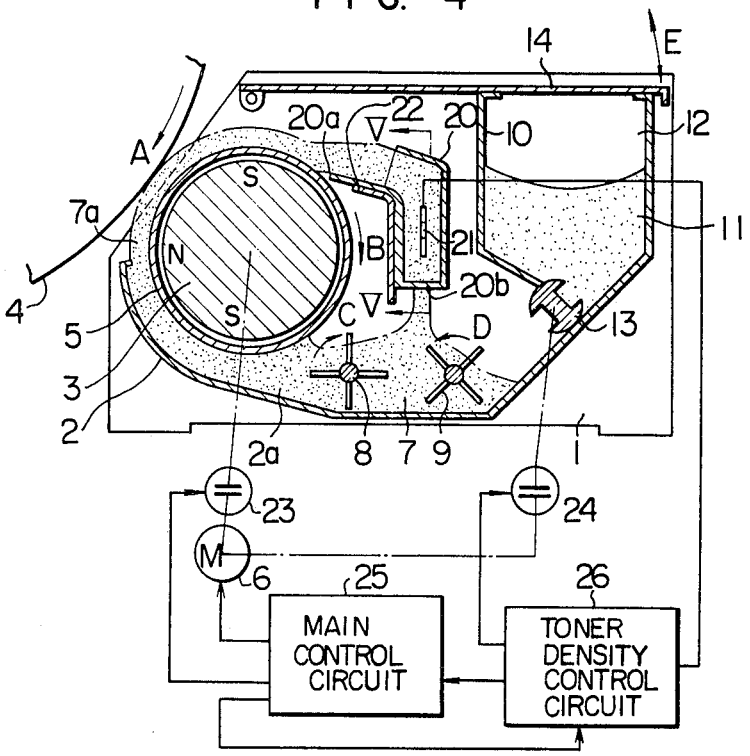
FIG. 4 is a partial sectional view of an electrophotographic copying apparatus, especially a development unit thereof, for practising another operation method according to the invention.
Figure 5:
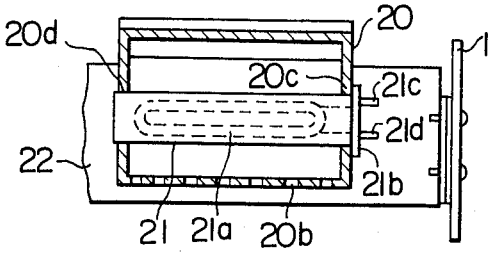
FIG. 5 is a sectional view taken on line V—V in FIG. 4.

The invention will now be described by way of such an embodiment with reference to FIGS. 4, 5 and 6.

In these figures, the same elements as those in FIG. 1 are designated by the same reference numerals. Developer powder 7 is passed through a guide tube 20 having an upper opening. An upper wall of the upper opening is bent toward the outer periphery of a sleeve 5 and a lower wall extending nearby the outer periphery of the sleeve 5 constitutes a guide plate **20*a* which draws a magnetic brush 7*a* on the sleeve 5 into the upper opening of the guide tube 20. The guide tube 20 has a bottom wall in which a great number of perforations 20*b* are formed. Accordingly, the developer powder 7 within the tube 20 is discharged into a developer container 2*a*, forming a laminar flow of the developer powder 7 which runs downwardly. Formed in intermediate vertical opposing walls of the guide tube 20 are windows 20*c* and 20*d* (see FIG. 5) through which a flat coil 21 is mounted. More particularly, the coil 21 is inserted into one window 20*c* until the fore end of the coil 21 fits in the other window 20*d*. Thus, the flat coil 21 is placed in a central flow path with its major flat surfaces arranged in parallel with the stream of the developer powder 7. Details of the flat coil 21 are shown in FIG. 5. The coil 21 comprises an oblong coiled conductor 21*a* encapsulated with resin (the encapsulation being so thin that ends thereof will not disturb the developer powder stream), and an end flange 21*b* on which lead terminals 21*c* and 21*d*** are mounted.

Returning to FIG. 4, a magnetic shield plate 22 is provided for shielding the guide tube 20 from magnetic flux of a magnet 3. The guide tube 20 is fixed to side plates 1 by the aid of the shield plate 22 being connected to the tube 20. Reference numeral 23 denotes a clutch for transmitting the rotation of a motor 6 to the sleeve 5, 24 a clutch for transmission of the motor rotation to a feed valve 13, 25 a main control circuit for the electrophotographic copying apparatus, and 26 a toner density control circuit.

Figure 6:
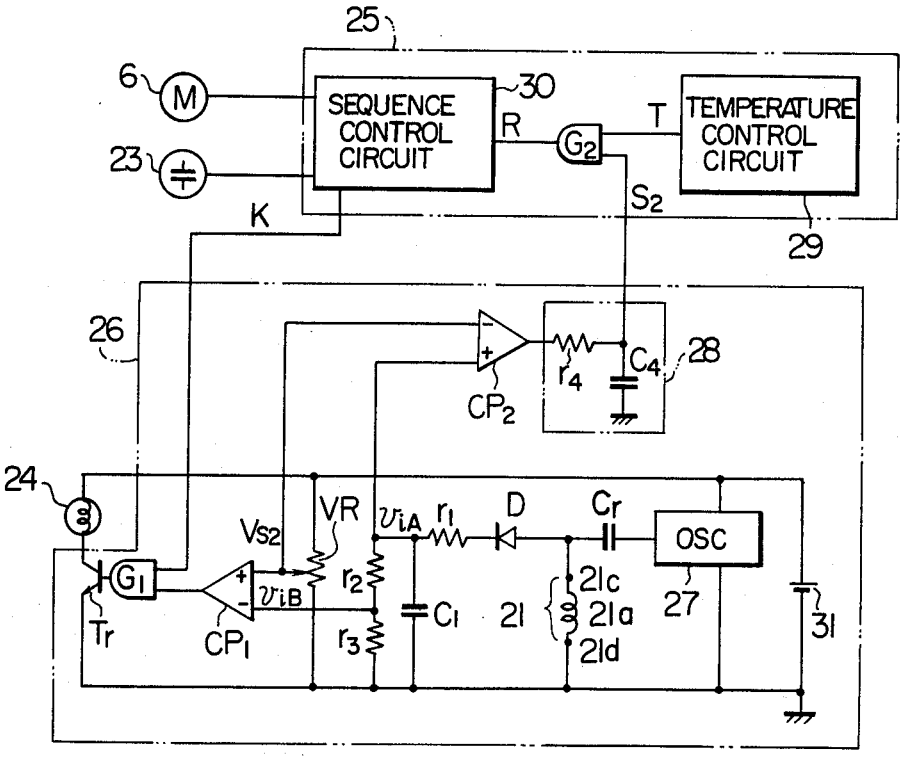
FIG. 6 is a circuit diagram of an electrical control circuit for the electrophotographic copying apparatus shown in FIG. 4.

With reference to FIG. 6, the conductor 21*a* of the flat coil 21 is connected in series with a coupling capacitor Cr to constitute a capacitive reasonance circuit which in turn is connected to an oscillator 27. A rectifier D rectifies voltage across the coil 21. A resistor $r_1$ and a capacitor $C_1$ constitute a smoothing circuit for smoothing the rectified voltage to produce smoothed voltage $v_{iA}$. The voltage $v_{iA}$ is divided by resistors $r_2$ and $r_3$, thereby producing voltage $v_{iB}$ across the resistor $r_3$. A potentiometer VR sets reference voltage $V_{s2}$ which is equal to a voltage $v_{iB}$ being obtained when a standard toner density developer is sufficiently stirred. A comparator $CP_1$ having a suitable hysteresis compares the detection voltage $v_{iB}$ with the reference voltage $V_{s2}$ and produces an output signal when the voltage $v_{iB}$ is smaller than the voltage $V_{s2}$ representative of the standard toner density. An AND gate $G_1$ connected to receive the output signal from the comparator $CP_1$ and an enabling signal K from the main control circuit is enabled in the presence of the two signals to produce an output signal being applied to the base of a transistor Tr, thereby energizing the clutch 24. A comparator $CP_2$ compares the detection voltage $v_{iA}$ with the reference voltage $V_{s2}$ and produces an output signal when the voltage $v_{iA}$ is larger than the voltage $V_{s2}$. A resistor $r_4$ and a capacitor $C_2$ constitutes an integrator 28 which integrates output signals from the comparator $CP_2$ and which produces an output signal $S_2$. A temperature control circuit 29 is provided for controlling temperatures of a fixing unit (not shown) and it produces an output signal T when temperature of the fixing unit reaches a level for fixing. An AND gate $G_2$ connected to receive the output signal T and the integrator output signal $S_2$ is enabled in the presence of the two signals to produce a ready signal R being applied to a sequence control circuit 30. The sequence control circuit 30 adapted to control sequence of the electrophotographic copying apparatus comprises a circuit for controlling the sequence of the electrophotographic copying process and a waiting sequence circuit. When the signal R is received by the circuit 30, a waiting sequence is switched to a process sequence. In the process sequence, the charging, light-exposure, development, transfer and fixing processes are activated by pressing a start switch (not shown), and during development process alone, the clutch 23 is energized and the enabling signal K is delivered out. The motor 6 is operated while main power is turned on except that an abnormal operation occurs. A constant voltage source 31 also supplies a constant voltage while main power is turned on.

With the above construction, when a power switch is turned on, the waiting process commences. Namely, rotation of the motor 6 drives the sleeve 5 and stirrers 8 and 9 shown in FIG. 4 through the clutch 23 and the developer powder 7 is stirred.

Figure 7:
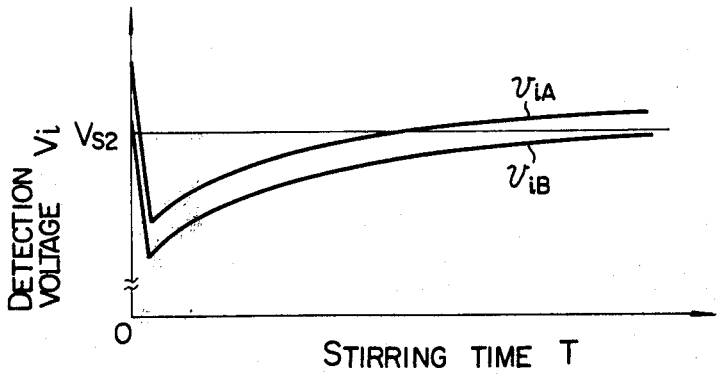
FIG. 7 is a graph showing the relation between stirring time for the developer and detection voltage (Vi)

Transient curves of the detection outputs $v_{iA}$ and $v_{iB}$ in the circuit of FIG. 6 trace as shown in FIG. 7 immediately after stirring is started by turning on the power switch. When the apparatus has been out of use, voltages $v_{iA}$ and $v_{iB}$ due to an inductance of the coil 21 per se are generated in the absence of the developer powder 7 inside the guide tube 20. Thereafter, as the sleeve 5 rotates, the developer powder 7 is charged into the guide tube 20, the detection voltages once decrease to values which approximately correspond to an inductance of the coil 21 modified by a developer permeability at stirring time t being zero and approach the reference voltage $V_{s2}$ as the stirring time proceeds.

Usually, it takes an appreciable time (5 to 6 minutes or more) from turning-on of the main switch for the detection voltage $v_{iB}$ to reach the reference voltage $V_{s2}$. Therefore, by setting the detection voltage $v_{iA}$ equalling the reference voltage $V_{s2}$ when the detection voltage $v_{iB}$ reaches a proper lower limit of the standard toner density, it is judged that stirring of the developer is completed at this time, and the comparator $CP_2$ produces the output signal. The integrator 28 comprised of resistor $r_4$ and capacitor $C_2$ is effective to remove an erroneous signal attendant on turning-on of the main switch which is generated in the absence of the developer before the initial supply of the developer to the guide tube 20 starts. Since temperatures of the fixing unit rise and the signal T is generated from the temperature control circuit 29 approximately when the output signal $S_2$ representative of the completion of stirring is produced from the integrator, the AND gate $G_2$ generates the ready signal R, the clutch 23 is deenergized, and the apparatus waiting condition is released. During this procedure, the enabling signal K is kept turned off so that the feed valve 13 will not operate, thus preventing excess flow of toner.

In addition, since the developer permeability or the toner density has a predetermined relation to the toner charge as described above, it is possible to prevent the reduction in initial developed image density by determining the amount of charge on the toner such that a sufficient density of developed images can be obtained when the detection voltage $v_{iA}$ reaches the reference voltage $V_{s2}$.

Moreover, this embodiment attains advantageous effects when the apparatus has not been used for a long time as well as when the developer is refreshed or exchanged, because a fresh developer for exchange with a degraded developer to be removed from the development unit has usually been placed in a stationary, cool and dark storage and hence has no charge, like the developer in the apparatus which has not been used for a long time when charged into the apparatus.

Figure 8:
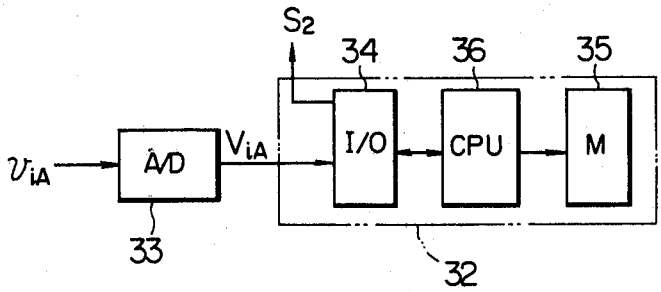
FIG. 8 is a partial block diagram of another electrical control circuit for the electrophotographic copying apparatus shown in FIG. 4.

Turning to FIG. 8, another embodiment of the invention utilizing a microprocessor 32 will be described.

In this second embodiment, detection voltage $v_{iA}$ (or $v_{iB}$) is converted into a binary signal $V_{iA}$ at an A/D converter 33 and then fed to the microprocessor 32. While a detection voltage $V_{iA}$ appearing upon closure of the main switch (t=0) is stored via an input/output circuit 34 in a memory 35 at an address $A_1$, a detection voltage $V_{iA}$ appearing a predetermined time, for example, one second after the closure of the main switch (t=1) is stored at an address $A_2$. A central processor unit 36 then computes $|V_{iA}(A_1)-V_{iA}(A_2)|$ and judges if $|V_{iA}(A_1)-V_{iA}(A_2)| \leqq K$. If not, a detection voltage $V_{iA}$ appearing, for example, 2 seconds later (t=2) is stored at the address $A_1$ and $|V_{iA}(A_1)-V_{iA}(A_2)|$ is computed. Subsequently, a detection voltage $V_{iA}$ appearing 3 seconds later (t=3) is stored at the address $A_2$ and $|V_{iA}(A_1)-V_{iA}(A_2)|$ is computed. In this manner, detection voltages $V_{iA}$ appearing at a predetermined interval are alternately stored at the addresses $A_1$ and $A_2$, and energization of the clutch 23 keeps the stirring continuing until $|V_{iA}(A_1)-V_{iA}(A_2)| \leqq K$ is established, thus enabling the developer to be charged by friction. Under the condition that $|V_{iA}(A_1)-V_{iA}(A_2)| \leqq K$, the control signal $S_2$ is delivered out.

As being without resort to the reference voltage $V_{s2}$, this embodiment is effective especially for setting the initial developed image density in the electrophotographic copying apparatus. Conventionally, after the electrophotographic copying apparatus is assembled as a whole, adjustment of the potentiometer is necessarily conducted following charging of the standard developer into the developer container and the preparatory operation (in which the photosensitive drum is not charged electrostatically), because the inductance of flat coil 21, the capacitance of coupling capacitor Cr and the circuit constants as well as the location where the guide tube 20 is mounted is settled within certain irregularity. Time for the preparatory operation is empirically determined and usually made longer than the practical stirring time for frictional charging from the standpoint of safe operation, resulting in prolongation of time for the adjustment process. In addition, when adaptation to developers of different specifications (directed to improved developers) on the market is desired, monitoring for these developers is not established and either immature or excessive stirring results. However, in accordance with this embodiment, the constant stirring following closure of the main switch can advantageously be established irrespective of hysteresis of stirring.

In lieu of the separate microprocessor as employed in this embodiment, the main control circuit 25 may take part in the signal processing if incorporated with an arithmetic circuit and a memory circuit. For detection of the developer permeability, the conductor inductance as in the foregoing embodiments may be replaced by a magnetic sensor such as a Hall device. In this case, it is necessary to provide a magnetic flux generator means such as a magnet associated with the magnetic sensor.

As has been described, in accordance with the invention, the development unit is raced until the amount of charge on the developer toner is raised to the predetermined level and thereafter the electrophotographic copying procedure commences, thereby preventing the reduction in initial developed image density and ensuring production of developed images of high quality.

What is claimed is:

1. In a method for operating an electrophotographic copying apparatus having a latent image forming unit for forming an electrostatic latent images on a recording medium, a development unit for visualizing the electrostatic latent image with a developer containing toner and carrier to produce a visible toner image, and a fixing unit for fixing the toner image, said method comprising the steps of:

racing said development unit prior to the normal developing operation until the amount of charge on the toner in the developer reaches a predetermined level; and thereafter commencing the electrophotographic copying procedure.

2. The operation method according to claim 1 wherein attainment of the amount of charge on the developer toner to the predetermined level is judged from a toner density which is detected by a toner density detector apparatus for detecting the toner density based on permeability of the developer.

3. The operation method according to claim 1 wherein said racing continues until change in charge on the toner within a predetermined time falls below a predetermined value.

4. A method for operating an electrophotographic copying apparatus having a latent image forming unit for forming an electrostatic latent image on a recording medium, a development unit for visualizing the electrostatic latent image with a developer containing toner and carrier to produce a visible toner image, and a fixing unit for fixing the toner image, said method comprising the steps of:

stirring the developer without consuming and feeding the developer;

detecting charge on the toner in the developer as a voltage;

detecting the voltage representative of the charge on the toner when it reaches a level sufficient to produce a predetermined density of images to be developed; and thereafter commencing an electrophotographic copying procedure.

5. The operation method according to claim 4 wherein attainment of the level sufficient to produce the predetermined density of developed images is judged from a toner density which is detected by a toner density detector apparatus for detecting the toner density based on permeability of the developer.

6. The operation method according to claim 4 wherein when attainment of the level sufficient to produce the predetermined density of developed images is completed, the stirring of the developer is stopped.

7. The operation method according to claim 4 wherein attainment of the level sufficient to produce the predetermined density of developed images is determined by detecting that change in the voltage within a predetermined time falls below a predetermined value.

* * * * *